US008945332B2

(12) United States Patent
Bogan

(10) Patent No.: US 8,945,332 B2
(45) Date of Patent: Feb. 3, 2015

(54) EXTERIOR COMPOSITE FINISH FLOORING

(76) Inventor: Francisco Bogan, Weston, FL (US)

( * ) Notice: Subject to any disclaimer, the term of this patent is extended or adjusted under 35 U.S.C. 154(b) by 101 days.

(21) Appl. No.: 13/615,461

(22) Filed: Sep. 13, 2012

(65) Prior Publication Data

US 2014/0069580 A1 Mar. 13, 2014

(51) Int. Cl.

| | |
|---|---|
| ***B32B 7/14*** | (2006.01) |
| ***B32B 27/08*** | (2006.01) |
| ***B32B 38/04*** | (2006.01) |

(52) U.S. Cl.

USPC ..... 156/265; 156/280; 156/299; 52/745.21; 52/745.05

(58) Field of Classification Search

CPC ..... B32B 7/14; B32B 21/042; B32B 27/08; B32B 37/0038; B32B 37/1284; B32B 38/04; E04F 15/02183

USPC ..... 156/265, 280, 299; 428/141; 52/742.16, 52/745.21, 745.05

See application file for complete search history.

(56) References Cited

U.S. PATENT DOCUMENTS

| | | | | |
|---|---|---|---|---|
| 3,297,630 | A * | 1/1967 | Giordano | 428/432 |
| 4,992,307 | A * | 2/1991 | Ikeda | 427/297 |
| 5,375,385 | A * | 12/1994 | Feder | 52/385 |
| 2010/0132303 | A1* | 6/2010 | Gill | 52/745.13 |
| 2010/0194780 | A1* | 8/2010 | Acworth | 345/619 |
| 2014/0069050 | A1* | 3/2014 | Bolin | 52/745.21 |

* cited by examiner

*Primary Examiner* — Linda L Gray

(74) *Attorney, Agent, or Firm* — Christopher J. Vandam PA; Chris Vandam

(57) ABSTRACT

A marine grade, exterior composite finish flooring comprised of a plurality of synthetic wood strips, evenly spaced and joined with a silicone adhesive. The fabrication process involves coating a board with a masking agent and then sawing the board into strips so that the masking agent is only on the tops of the strips and not on the edges. Then adhering the strips to a substrate to achieve proper spacing and orientation. A silicone adhesive caulk is then pressed into the joints and allowed to partially cure. The caulk stuck on the surface of the boards is easily removed as a result of the masking agent. Completed panels are then adhered to a subfloor, for example on the deck of a boat for a durable and aesthetically pleasing deck surface.

5 Claims, 2 Drawing Sheets

EXTERIOR COMPOSITE FINISH FLOORING

BACKGROUND OF THE INVENTION

1. Field of the Invention

The present invention relates to flooring materials, and more particularly, to a multi-part synthetic finish flooring ideally suited for exterior or marine environments.

2. Description of the Related Art

Several designs for exterior synthetic flooring have been designed in the past. None of them, however, includes prefabricated synthetic, wood and polymeric based boards that are cold joined into finish flooring that can be simply and conveniently made yet ideally suited for harsh exterior and marine environments.

Traditional exterior finish flooring and marine decks are laid over fiberglass, wood or metal decking. A painstaking system requiring skilled tradesmen adheres deck boards individually and then seals the seams between the boards. This can cost, as of 2012, over $100 per square foot of deck laid. In addition to cost, the time required to complete a job is significant. The skill required to lay such a finish floor is high so only specially skilled laborers can complete such a job.

Other solutions to a traditional method include using a sheet based laminate, often supplied on a roll and adhered to the vessel's deck. These products are obviously synthetic and thus lack the visual appeal of traditional decking materials.

Other known processes, products and patents describe similar subject matter and provide for a number of more or less complicated and expensive products and methods of installation and manufacture that fail to solve the problem in an efficient and economical way. None of these known patents or commonly used processes suggest the novel features of the present invention.

SUMMARY OF THE INVENTION

It is one of the main objects of the present invention to provide a highly durable flooring surface.

It is another object of this invention to provide a flooring surface that is resistant to degradation from light, heat, salt water and other factors in an outdoor marine environment.

It is still another object of the present invention to provide an aesthetically appealing marine decking surface.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
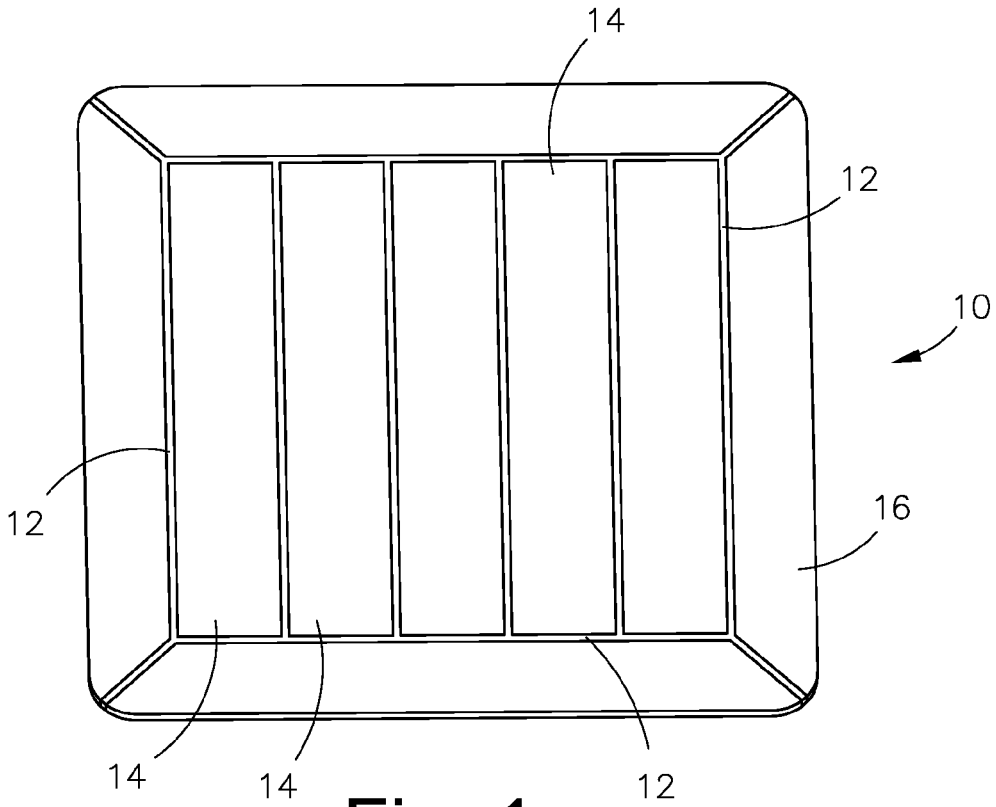
FIG. 1 represents a plan view of an example of an exterior composite finish flooring panel.
Figure 2:
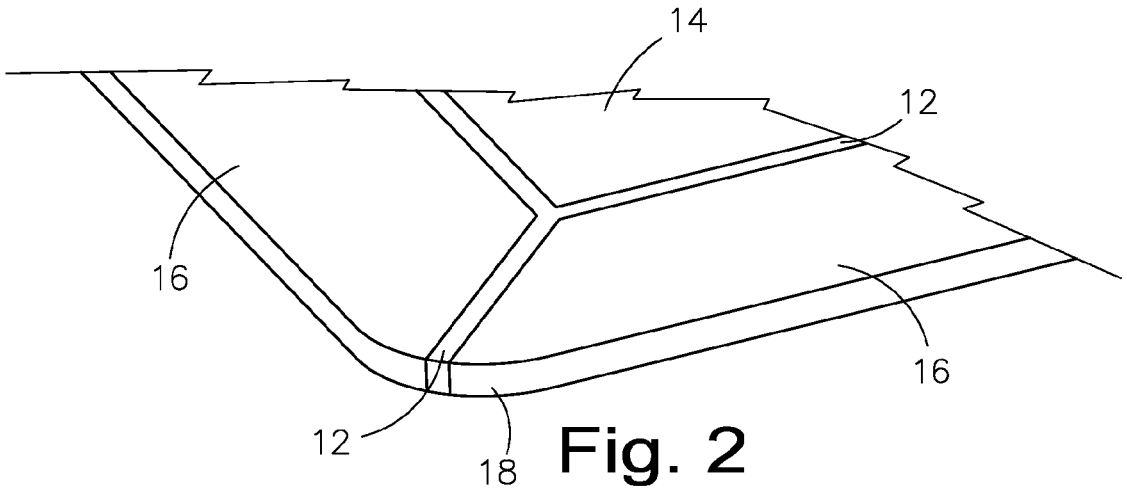
FIG. 2 shows a partial perspective view of a flooring panel similar to that shown in FIG. 1.

Referring now to the drawings, where the present invention is generally referred to with numeral 10, it can be observed that it basically includes caulk 12, a series of boards 14 and another series of boards 16. The boards 16 also show an exposed edge 18.

Generally, the boards 14 and 16 are adhered to each other in a predetermined pattern with an adhesive caulking. The multiple boards 14 and 16 result in a panel. The caulking 12 allows the resulting panel some flexibility as well as appearing like a traditionally laid deck surface. The caulking 12 is also more stain resistant and can also provide some traction attributes.

The rough surface of the top-side requires a durable yet aesthetically pleasing surface. The top, visible surface of the boards 14 and 16 may optionally have a pattern embossed surface. This can commonly be a faux wood grain, a grippy pattern or a logo or symbol that complements the balance of the dècor.

Materials used for the construction of finish flooring include a few basic and commonly available products. The boards 14 and 16 are preferably made of a synthetic wood product. Alternatively, boards 14 and 16 can be made of other durable and inert products such as plastics or composite resin-based products.

Typically synthetic wood this composed of approximately seventy percent polymeric and about thirty percent natural wood shavings. The wood shaving are often a byproduct other commercial and industrial processes. This synthetic wood is cooked to form a solid sheet unifying the several components permanently.

All the materials in the synthetic wood composition work together. The result is a great resistance to wearing down under almost all uses and environmental conditions.

Synthetic wood is sometimes referred to as wood plastic composite (WPC). They produced by thoroughly mixing ground wood particles and heated thermoplastic resin. The most common method of production is to extrude the material into the desired shape, though injection molding is also used. WPCs may be produced from either virgin or recycled thermoplastics including HDPE, LDPE, PVC, PP, ABS, PS, and PLA. Additives such as colorants, coupling agents, UV stabilizers, blowing agents, foaming agents, and lubricants can all optionally be added, depending on the application.

The caulk 12 is preferably a high grade silicone and/or polyurethane based adhesive sealant. UV stabilizers for sunlight protection are typically additives in a marine formula such as this. Various colorants may be included to coordinate the color of the caulk 12 with the color of the boards 14 and 16.

Silicone caulk is preferred because of its useful properties that include low thermal conductivity, low chemical reactivity and low toxicity. It is also thermally stabile meaning that it has a constancy of properties over a wide temperature range of about −100 to 250° C. Obviously, this would cover the performance range needed for most flooring applications. It also has the ability to repel water and form watertight seals. Generally, silicones do not support microbiological growth, have excellent resistance to oxygen, ozone, and ultraviolet (UV) light, all of which are important features for marine environments.

An important variety of caulk 12 is a mono-component polyurethane adhesive sealant caulk. It is resistant to the saline water and sunlight as well as other environmental conditions commonly occurring on a vessel. Particular varieties will have an excellent thixotropic properties to spread out easily and auto-level. This can avoid the necessity of additional mechanical clamps and fixtures. Once cured the adhesive is extremely resistant to most chemicals, remains elastic and is impermeable to moisture and waterborne contaminants such as sun screen lotions, fish blood and other liquids.

It polyurethane has other advantages, some enhanced in particular formulas, including that it can reduce slippery surfaces and related injury risks, it absorbs impacts from falling objects without substantial damage to the vessel, it remains permanently elastic and can thermally expand and contract which reduces stress experienced by the various components to increase longevity of the boards 14 and 16, the caulk's 12 adhesion capabilities to the boards 14 and 16 as well as the entire panel's adhesion to a substrate such as the fiberglass decking of the vessel onto which the panel is adhered.

A primer is an important product in the manufacture and assembly of the boards 14 and 16 into a panel. A principal product is a mono-component epoxy-polyurethane primer. It is generally transparent (or slightly yellowish) but can also be tinted depending on the color of the boards 14 and 16 or the application. A preferred product will have a density at 20° C. of approximately 0.9 kg/L. Use of such a primer allows the application of sealants on humid substrates (approximate humidity <8%). An advantage of using a primer is that the waiting time is substantially shortened before the component parts can be adhered to one another. It is very easy to apply by spray, brush or roller applicators. Obviously, it has an excellent adhesion enhancing characteristic when impregnated into the synthetic wood surfaces to be adhered.

The primer is the one that allows the homogeneous compatibility between the synthetic wood and silicone and enhancing between them a solid, permanent and watertight union. It should be appreciated that the formulation of the primer should be carefully matched to that of both the substrate (i.e. synthetic wood or subfloor) and the adhesive sealant used to connect the pieces.

A masking liquid is a protector that has been especially designed to protect the surface during the action of the application of silicone caulking to avoiding any damage to areas where it is not intended to be applied. During the assembly process some silicone may be inadvertently applied to a surface. Also, some surfaces that are directly adjacent to the surfaces onto which the silicone is intended to be applied will come into contact with the silicone. It is important to get full coverage of the silicone onto the joints between pieces so inevitably the caulk will come into contact with surface that must show without being marred by caulk.

The masking liquid is used in the process to allow liberal application of caulk to the joints so that the excess can be trimmed or scraped away leaving a solid joint and a clean line between the caulked surface and any adjacent surface.

When dried, the masking liquid forms a plastic film resistant to the penetration of the solvents used to clean the residues. It does not stain nor damage the surface of the synthetic wood. It is minimally volatile and not harmful to humans, animals or the environment. It is used in accordance with the environmental specifications intended by the manufacturer of the masking liquid.

Masking liquid can be made from a variety of materials. It generally prevents a coating, such as silicone, from adhering to a surface which results in the ability to achieve clean edges. Often masking liquid is made from latex or other polymers, molten or softened wax or gesso. Other formulas may be available in the common art that may also achieve the same ends.

Figure 3:
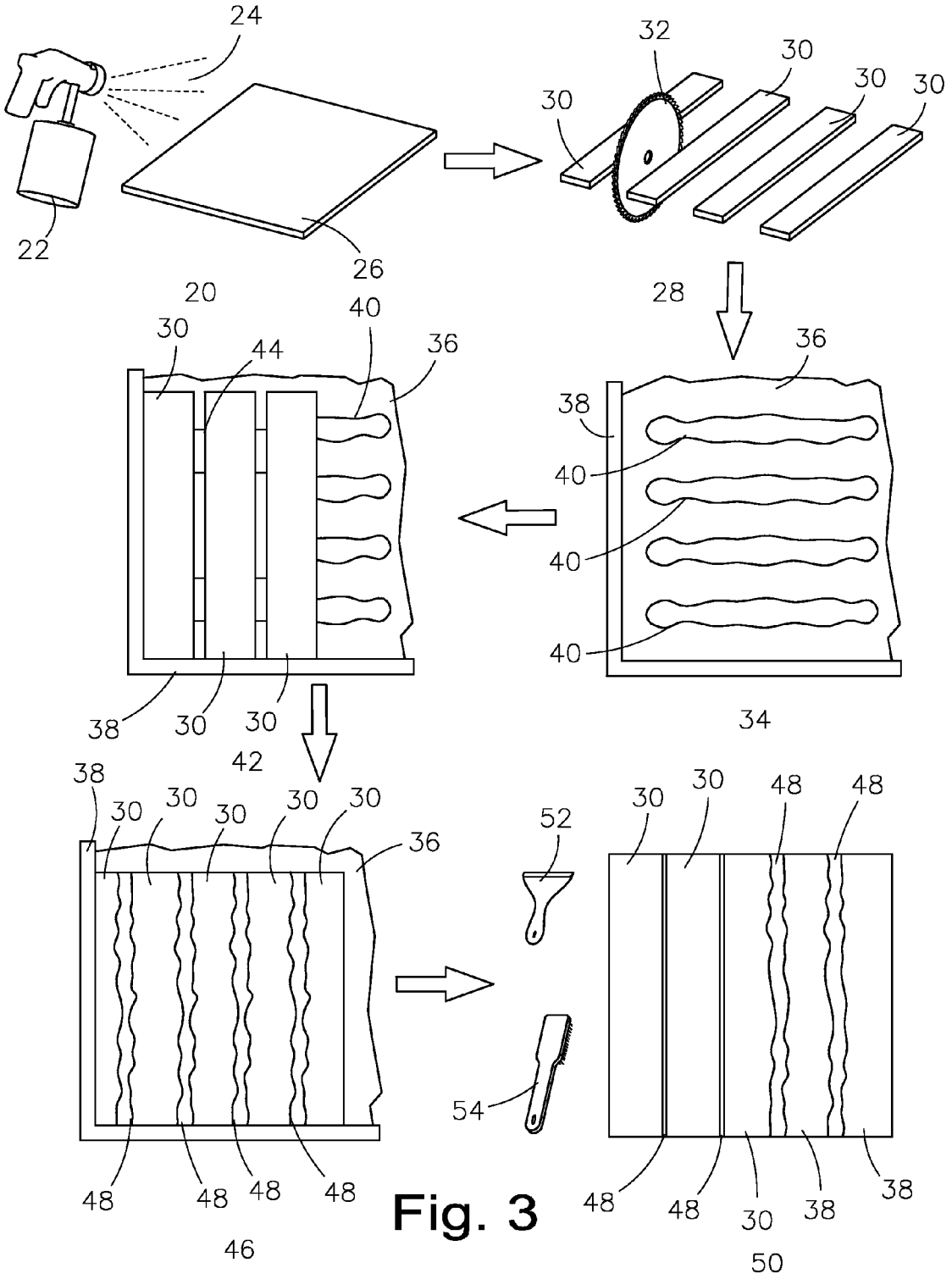
FIG. 3 illustrates a multi-step process diagram summarizing the steps of construction of an exterior composite finish flooring panel.

The process of construction is demonstrated in FIG. 3 starting at a first step 20 where a board 26 is coated with a masking liquid 24 applied by a sprayer 22. By spraying the masking liquid 24 at an early stage it is only applied precisely to a top side of the board that is visible in the finished product as the actual surface of the floor.

Next, in step 28 a saw 32 is used to cut the board 26 into thinner boards 30. Notice that the masking liquid 24 is not on the edges of the boards 30 where they were cut by the saw 32. This provides a crisp demarcation between the fresh edges made by the saw 32 that can later be easily adhered without interference from the masking liquid 24. The edges of the boards 30 can then be treated with a primer that enhances the adherence of the caulking to the edges of the boards 30.

In step 34 a backing 36 is laid on a flat surface, such as a table. The backing 36 is set into the corner of squaring jig 38 to help keep all the components square to each other during the assembly process. Several stripes of adhesive 40 are laid onto the backing 36. The adhesive 40 is laid substantially perpendicular to how the boards 30 will later be oriented. The adhesive 40 may be applied with a tube type dispenser and then smeared flat to allow even adhesion to the boards 30.

In step 42 the first board 30 is set into the adhesive 40 on the backing 36 tight against the jig 38. This adheres the first in a series of boards 30 to be affixed to the backing 36. For subsequent boards 30 a spacer 44 is placed between the added board 30 and the prior board 30. This provides even spacing through a series of boards ensuring that each one is parallel to the next board 30. The adhesive 40 is the allowed to fully cure so that each of the boards 30 are held in relative position.

Next, in step 46, the spacers 44 are removed from between the boards 30. The gaps between the boards 30 remain even because they are stuck to the backing 36. A caulk 48 is then injected into the gaps between the boards. The caulk 48 bonds extremely well to the edges of the boards 30 because of the primer applied to the edges of the boards 30 as described in step 28, supra. A tool such as a putty knife or other similar device then is used to firmly press the caulk 48 into the gaps ensuring full contact between the caulk 48 and the edges of the boards 30.

Notice that some of the caulk 48 is spread onto the top surface of the boards 30 during this process in step 46. The masking liquid 24 is between the top surface of the boards 30 and the caulk 48. However, the caulk 48 is not present on the edges of the boards 30 where the saw 32 cuts were made.

By the time step 50 is initiated the caulk 48 has cured sufficient to remove the excess caulk 48 on the top surface of the boards 30 without damaging the caulk 48 in the gaps between the boards 30. A scraper 52 or brush 54 can be used to mechanically remove the excess caulk 48. An electric wire wheel, rag or other mechanical means can also be used to separate the caulk 48 from the top of the boards 30 while leaving the caulk between the boards 40 unaffected.

The reverse of the boards 30 may also be cleaned of the adhesive 40. The liquid mask 24 may also have been applied to the reverse of the boards 30 to aid in this process. The completed product may then be set aside for complete curing and later assembly onto a subfloor for use in its final application.

Optionally, an additional process step of applying a clear sealer to the surfaces of the device is completed and allowed to cure. Said sealer may have ultra-violet protectants and stabilizers, mildewcides, fungicide, water-proofers and/or any other available protectant or performance enhancement coating.

An alternate approach to the device can be characterized as follows. The first step for the construction of the flooring is to define the parameters of the model or template to be made. The template is a model of the combined strips of synthetic wood that will cover a given subfloor. This determines the dimensions of the form to be constructed and may also vary depending on the use. At this step the dimensions are defined such as the width and length of the wood strips or planks that comprise the assembled device.

A template can be pre-fabricated digitally or structurally. This is determined by the space, size, complexity and visual access of the fabrication and installation area.

Digital templates are developed in a computer program tailored not only for boats but also for other applications. It is adapted for easy visual access to areas from a perspective view above the project. Through the software program pictures in high resolution are taken of the area to covered with the floor. Then after being digitized an image of the floor will be projected and sent to the fabricators to cut the components of the floor according to the required measurements as per information and specifications generated by the program based on the digitation of the subfloor to be covered.

Structural templates may be used instead of a digital template. Thin plastic or wood is utilized as model for the cut of our floor. The production of the structural templates are done similar to other conventional systems in allowing the fitter to obtain an exact copy of the area to cover. Generally the strips of thin plastic or wood are glued to each other to create a boarder of the total area to be covered with the flooring material.

Once a structural template is made it can be removed from the surface onto which it has been fit and can be used to create a digital template without any impediments such as the superstructure of the boat. The structural template can be placed on any open area of fabricating space to be digitized optically.

The synthetic wood strips or subcomponents (sometimes referred to as ribbons) have a standard length of about 3.60 lineal meters, with a width of 5.3 cm. The thickness of the ribbons range from about 4 mm to 2.5 cm of thickness, depending on the engineering requirements. It should be appreciated that other material dimensions can equally be utilized depending on the available stock.

In order to construct the synthetic wood panels, for example with general measurements of 120 cm×244 xm and up to 300 cm×600 cm or more, tables with corresponding dimensions are required. The surface of this tables are coated with a material made of a plastic and polymer base that rejects the adhesion of any type of glue. Preferably just a mild adherence is achieved allowing the product to gently keep from slipping on the tables during manufacture Before placing the synthetic wood ribbons on the tables, we place fine layers of slow drying glue with polymeric. We make horizontal lines of not more than about one centimeter of separation between them until completing the surface to work.

Then we placed on the surface of the table the glue, then proceeding with the placing on the surface of the table between each one of the panels or ribbons of synthetic wood separators (or spacers). The separators typically measure three centimeters in height and may be of varying widths depending on the specifications.

Once properly spaced all of the panels or ribbons need a wait of about fifteen minutes for the glue to set. When the glue is dried between the panels, a specially formulated masking liquid is applied which protects the surface of our synthetic wood. This making liquid dries almost immediately creating a protection film, like a skin, that is later taken off after the caulking of the pieces together.

With the surface of our synthetic wood protected we immediately remove all the separators which allow our panels or ribbons to keep united at a fixed spacing. The glue, as previously applied keeps perfectly respected spaces of about four millimeters between the panels.

When all the spacers between the synthetic wood already removed and the surface protected with our masking liquid, the panels are sprayed with fast drying primer that is specially formulated to create a perfect adherence between our synthetic wood and the high grade silicon caulk with UV protection.

With the surface of the synthetic wood protected and also with the internal edges of the composite wood impregnated with primer, then we proceed to caulk and fill up the empty spaces between the panels or ribbons, making sure all the spaces or separations are perfectly filled up. The surface is then pressed with a semi-rigid spatula to achieve a perfectly bonded surface resulting in homogeneous panels. Thus, the silicone is flattened throughout the surface of the synthetic wood. This is the reason why the application of the masking liquid has to be perfect. Leaving any surface without covering should be avoided, otherwise it will cause damage to the synthetic wood.

The silicone for the caulking is preferably fast dry (fast-cure). It dries to the touch after about fifteen minutes after its application and completely in about six hours. When dried to the touch we proceed to remove the excess silicone that remained on top of the masking liquid with a solvent or water base cleaner. This way the silicone will be on the edges of wood and the surface of our synthetic wood remains perfectly clean of any residue without suffering any damage.

At the end of this process, we install our nautical floor panels in a surface perfectly flat for the final curing of the silicon grade with UV protection for six more hours. Then our panels are completely ready to begin working, giving them form and uses.

With this method the installers work on the boats only at the moment of gluing, without causing any disturbance or dirt in the area at the moment of installation where only a few ours are needed to complete the installation.

The present invention can be fairly described as a finish flooring panel construction method comprised of first coating a board with a liquid masking agent then allowing said liquid making agent to cure. The liquid masking agent substantially prevents an adhesive from bonding to said board. Then ripping the board into parallel strips thereby exposes the edges of said strips that have not been coated with said liquid masking agent. Essentially, fresh edges are created on the strips when they are ripped. By applying an adhesive to a temporary substrate surface the strips can be aligned and affixed with said adhesive onto the substrate surface in a predetermined pattern with predetermined gaps between each of the strips. Any pattern can be made but ones with even gaps often look best. The technician then fills the gaps between the strips with a caulk. Often this caulk is a contrasting color and is used to adhere the strips together firmly. Then allow the caulk to partially cure. Then remove the caulk not in the gaps between the strips. This is made much easier by the previously applied masking liquid. Then allow the caulk to fully cure.

Optionally and preferably the board is a composite material made of a combination of resins and real wood particles. Other wood or synthetic materials may be used effectively as well. The caulk is preferably a silicone based caulk with ultraviolet stabilizers adapted for a marine environment but may be any available adhesive caulk or other adhesive. The predetermined pattern is computer generated and that pattern is used to lay out the strips into the designated pattern. Ideally, a final step includes the application of a clear sealer coat applied to the surface of the finish flooring panel.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A finish flooring panel construction method comprised of:

a—coating a board with a liquid masking agent then allowing said liquid making agent to cure; said liquid masking agent substantially prevents a caulk from bonding to said board;

b—ripping the board into parallel strips thereby exposing an edge on each of said strips that has not been coated with said liquid masking agent;

c—applying an adhesive to a temporary substrate surface;

d—aligning a plurality of the strips onto the temporary substrate surface in a predetermined pattern with predetermined gaps between each of the strips;

e—filling the gaps between the strips with the caulk so that the caulk bonds to the edges of each of the strips resulting in a panel;

f—allowing the caulk to partially cure;

g—removing the caulk in contact with the masking agent but not in the gaps between the strips;

h—allowing the caulk to fully cure;

i—separating the panel from said temporary substrate surface and applying the panel onto a subfloor.

2. A finish flooring panel construction method as disclosed in claim 1 further characterized in that said board is a composite material made of a combination of resins and wood particles.

3. A finish flooring panel construction method as disclosed in claim 1 further characterized in that said caulk is a silicone based caulk with ultraviolet stabilizers adapted for a marine environment.

4. A finish flooring panel construction method as disclosed in claim 1 further characterized in that said predetermined pattern is computer generated.

5. A finish flooring panel construction method as disclosed in claim 1 further characterized in that a final step includes the application of a clear sealer coat applied to the surface of a finish flooring panel.

* * * * *